US007695416B2

(12) United States Patent
Weiner

(10) Patent No.: US 7,695,416 B2
(45) Date of Patent: Apr. 13, 2010

(54) DEVICE AND METHOD FOR KNEE JOINT REHABILITATION

(76) Inventor: Jay John Weiner, 11 Lake Cumberland Dr., Fairfield, OH (US) 45014

( * ) Notice: Subject to any disclaimer, the term of this patent is extended or adjusted under 35 U.S.C. 154(b) by 0 days.

(21) Appl. No.: 11/868,056

(22) Filed: Oct. 5, 2007

(65) Prior Publication Data

US 2009/0093353 A1 Apr. 9, 2009

(51) Int. Cl.
*A63B 21/00* (2006.01)

(52) U.S. Cl. ..... 482/137; 482/112; 601/5; 601/35

(58) Field of Classification Search ..... 482/1, 482/4, 5, 7, 111–113, 129–130, 133–137, 482/903, 907; 601/23, 26, 33–35, 5
See application file for complete search history.

(56) References Cited

U.S. PATENT DOCUMENTS 3,822,599 A * 7/1974 Brentham ..... 482/113
3,975,051 A * 8/1976 Ballagh ..... 297/423.32
4,063,726 A * 12/1977 Wilson ..... 482/5
4,227,689 A * 10/1980 Keiser ..... 482/113
4,291,787 A 9/1981 Brentham
4,441,708 A * 4/1984 Brentham ..... 482/112
4,566,692 A * 1/1986 Brentham ..... 482/8
4,691,694 A * 9/1987 Boyd et al. ..... 601/34
4,732,380 A * 3/1988 Maag ..... 482/134
4,784,121 A * 11/1988 Brooks ..... 601/34
4,848,739 A * 7/1989 Schaub et al. ..... 482/113
4,905,676 A 3/1990 Bond et al.
5,320,641 A * 6/1994 Riddle et al. ..... 606/243
5,403,251 A 4/1995 Belsito et al.
5,562,579 A * 10/1996 Sheikowitz ..... 482/138
6,071,216 A * 6/2000 Giannelli et al. ..... 482/100
2001/0018387 A1* 8/2001 Webber ..... 482/142
2002/0193710 A1* 12/2002 Main et al. ..... 601/5
2005/0227837 A1* 10/2005 Broadbent ..... 482/148

OTHER PUBLICATIONS

Thomas P. Branch, MD, et al., Mechanical Therapy for Loss of Knee Flexion, The American Journal of Orthopedics, Apr. 2003, pp. 195-200.
R. Alexander Creighton, MD, et al., Arthrofibrosis: Evaluation, Prevention, and Treatment, Techniques in Knee Surgery, vol. 4, Issue 3, 2005, pp. 163-172.
Alexander Sapega, M.D., Arthrofibrosis (Stiff Knee Syndrome), The Knee and Shoulder Centers of New Jersey and Pennsylvania, www.kneeandshoulder.md/print/print_arthro.html, undated educational guide, 3 pages.

* cited by examiner

*Primary Examiner*—Fenn C Mathew
*Assistant Examiner*—Andrew M Tecco
(74) *Attorney, Agent, or Firm*—Wood, Herron & Evans, LLP

(57) ABSTRACT

A device for increasing the range of motion of a patient's knee joint generally includes a frame, a lever member pivotally coupled to the frame at a first location, and an actuator pivotally coupled to the frame at a second location. The frame supports the patient in a manner that allows motion of the patient's knee joint, and the lever member bears against a portion of the patient's body below the knee joint. The actuator is also pivotally coupled to the lever member. When operated by a controller, the actuator generates a translational input that rotates the lever member relative to the frame and thereby stretches the patient's knee joint in a desired direction.

20 Claims, 3 Drawing Sheets

DEVICE AND METHOD FOR KNEE JOINT REHABILITATION

TECHNICAL FIELD

The present invention relates generally to rehabilitation devices and methods, and more particularly to a device and method for increasing the range-of-motion of a patient's knee joint.

BACKGROUND

Many types of injuries and surgeries can result in an individual losing some range of motion in his or her knee joint. For example, patients who undergo surgery to treat anterior or posterior cruciate ligament reconstructions, meniscus tears, femur fractures, tibia plateau fractures, or other injuries associated with the knee joint or nearby areas of the body often experience some degree of arthrofibrosis (joint stiffness). Indeed, arthrobrosis is one of the leading complications of knee surgery. This undesirable condition results from the formation of extensive, internal scar tissue and other factors that limit motion of the patient's knee joint. Arthrofibrosis may involve the loss of flexion (bending movements), the loss of extension (straightening movements), or both.

To treat arthrofibrosis, a patient must typically follow a specially planned, intensive protocol of serial stretching and overpressure therapy. This protocol is primarily carried out through hands-on treatment from a physical therapist in a clinic. Although physical therapy may help the patient regain partial or full range-of-motion, the closely-supervised treatment can be relatively expensive and inconvenient for the patient. Several physical therapy sessions are often required each week to treat arthrofibrosis, which means that the patient must adjust his or her schedule accordingly.

As a result, some orthopedic surgeons recommend using in-home mechanical therapy devices as an alternative to (or to decrease reliance on) hands-on physical therapy. Several mechanical devices have been developed to stretch a patient's knee joint and thereby urge increased motion. Current devices, however, leave significant room for improvement.

For example, many of the current in-home mechanical therapy devices are complex to operate, involve numerous parts, or have limited effectiveness. These devices may require the patient to actuate levers, stabilize components, or perform other functions while attempting to stretch his or her knee joint, which may be a painful process that requires concentration itself. Moreover, many of the in-home mechanical devices are not designed to stretch the knee joint in both flexion and extension. The use and storage of two separate devices to treat joint stiffness can be cumbersome.

Although automated continuous passive motion (CPM) machines exist for more effectively stretching knee joints and other areas of the body, these machines are not designed for in-home use. In particular, these machines typically include a mechanical leg cradle that bends and straightens the patient's knee while the patient sits or lies down on a supporting surface. Machines including the supporting surface occupy a significant amount of space and are intended for facilities dedicated to treatment (physical therapy facilities, etc.), which have the space to accommodate such machines. The machines are also relatively expensive because of their complexity.

For at least these reasons, a mechanical therapy device that effectively stretches a patient's knee joint and that is suitable for in-home use would be highly desirable.

SUMMARY

A device for increasing the range of motion of a patient's knee joint according to one embodiment of this invention generally comprises a frame and a lever member pivotally coupled to the frame. The frame is configured to support the patient in a manner that allows motion of the patient's knee joint. The lever member is configured to bear against a portion of the patient's body below the patient's knee joint when the patient is supported on the frame. An actuator is pivotally coupled to the frame and the lever member. When operated by a controller, the actuator generates a translational input that rotates the lever member relative to the frame and thereby stretches the patient's knee joint in a desired direction.

In one aspect or embodiment, the actuator includes a drive member pivotally coupled to the frame and a shaft extending from the drive member. The shaft includes an end portion pivotally coupled to the lever member. When the actuator is operated by the controller, the drive member moves the shaft in a substantially linear direction to generate the translational input that rotates the lever member. The actuator may comprise, for example, an electromechanical linear actuator with the drive member being an electric motor.

A method of increasing the range of motion of a patient's knee joint using the device is also provided. The method in one embodiment generally comprises positioning a patient on the frame so that the patient is supported by the frame, positioning the lever member against a portion of the patient's body below the patient's knee joint, and operating the actuator with the controller. As indicated above, operating the actuator generates a translational input that rotates the lever member relative to the frame and thereby stretches the patient's knee joint.

BRIEF DESCRIPTION OF THE DRAWINGS

The accompanying drawings, which are incorporated in and constitute a part of this specification, illustrate exemplary embodiments of the invention.

DETAILED DESCRIPTION

Figure 1:
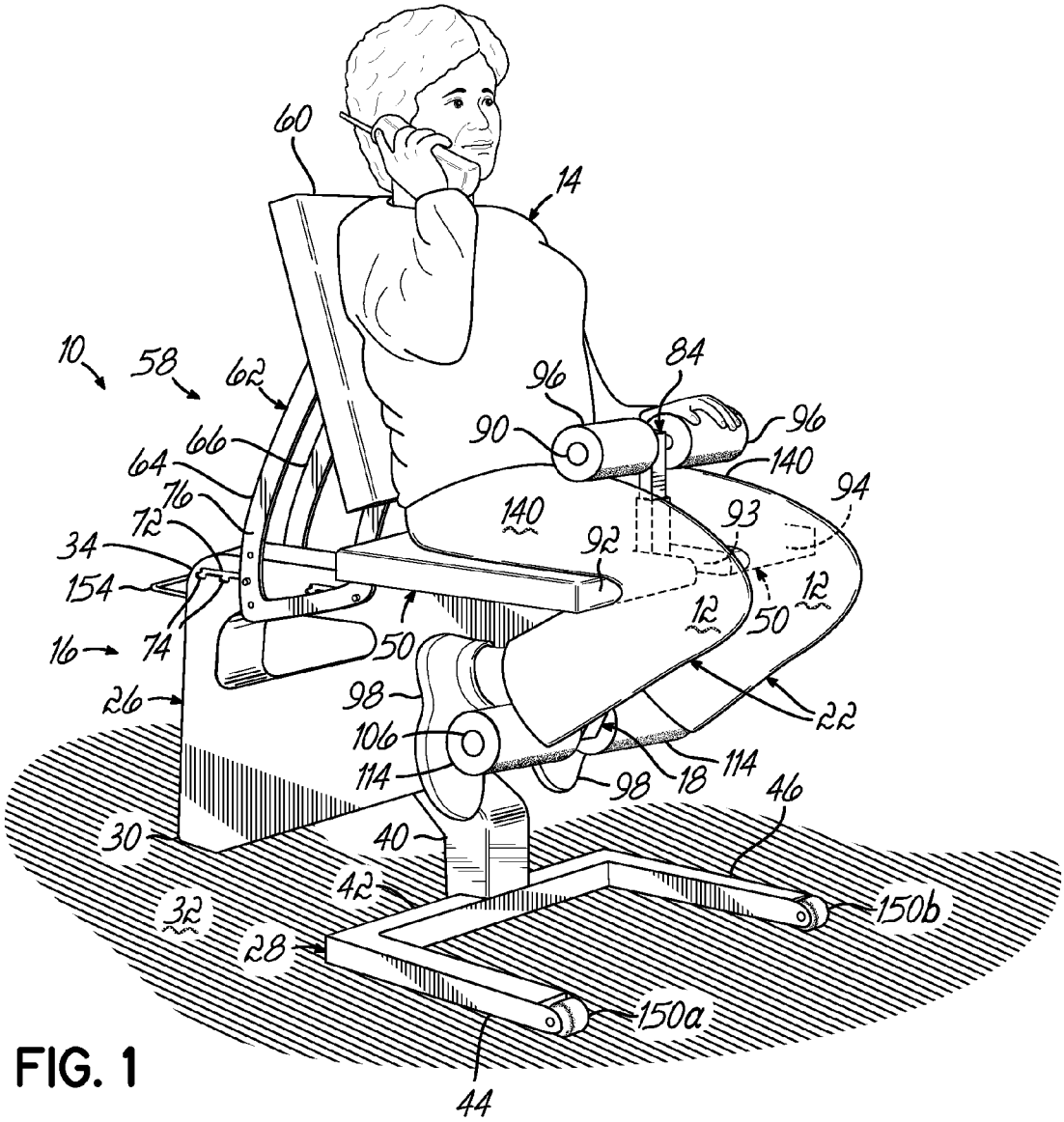
FIG. 1 is a perspective showing a patient using a device according to one embodiment of the invention for increasing the range of motion of the patient's knee joint.
Figure 2:
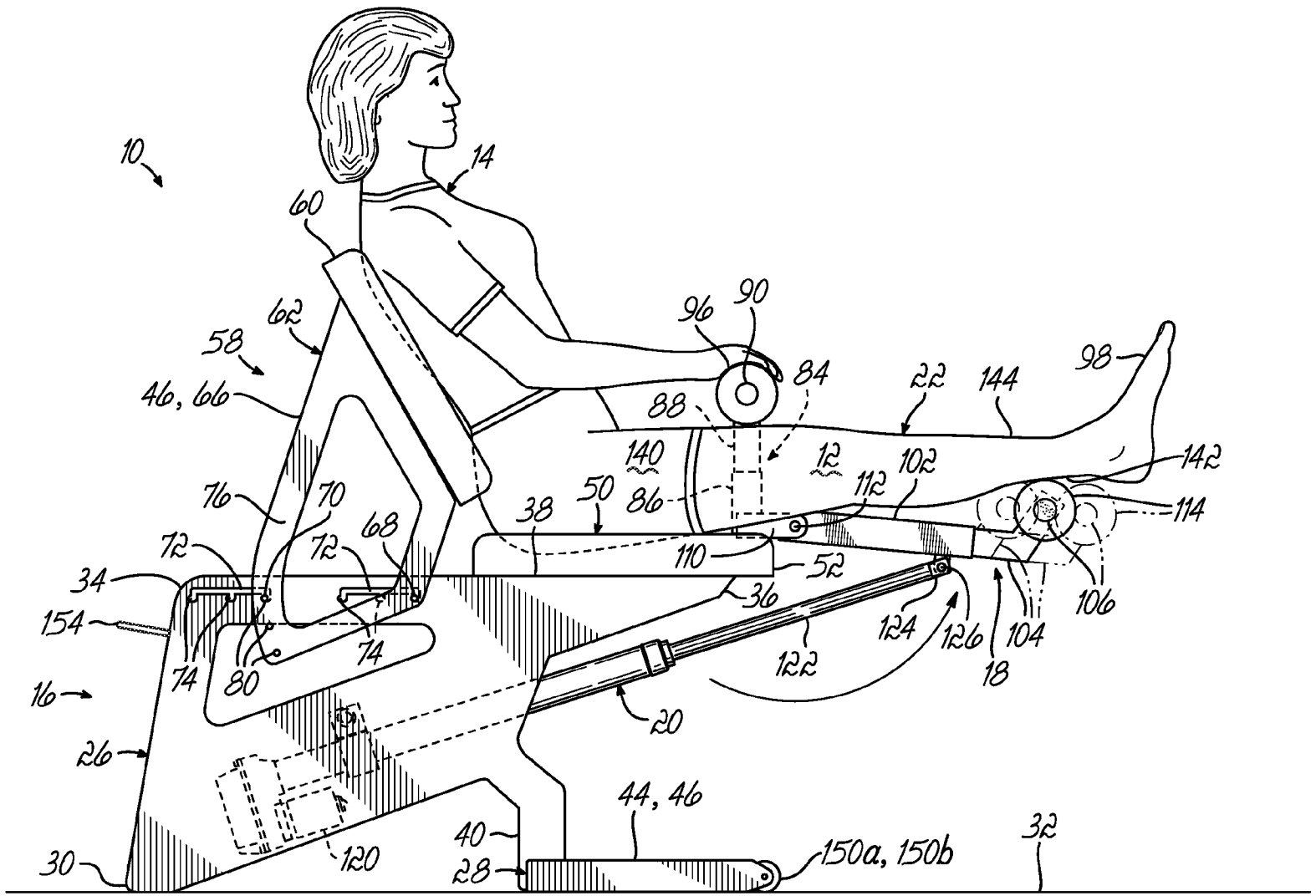
FIG. 2 is a side elevational view of a patient using the device of FIG. 1 to stretch the patient's knee joint in extension.
Figure 3:
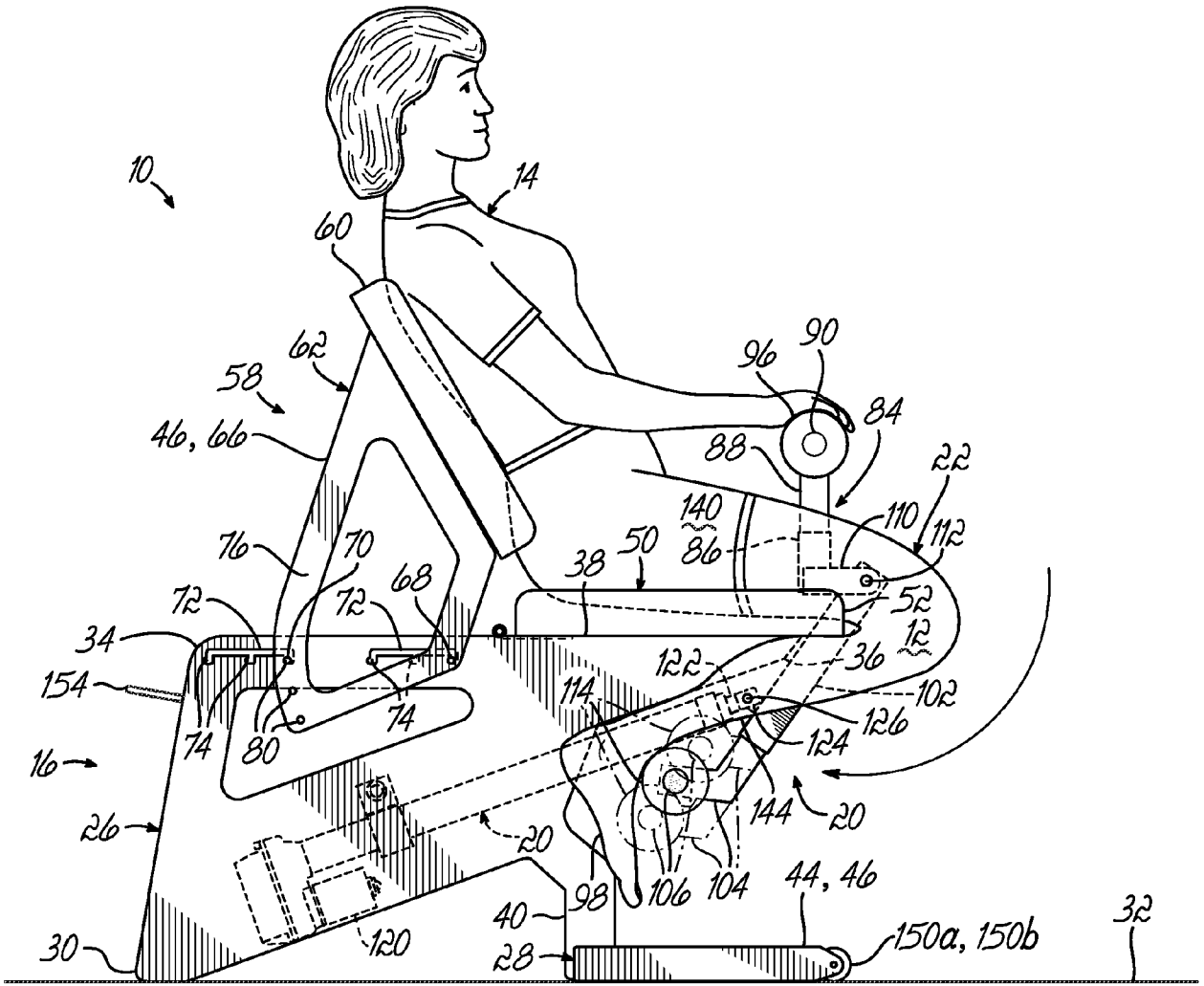
FIG. 3 is a side elevational view of a patient using the device of FIG. 1 to stretch the patient's knee joint in flexion.

With reference to FIGS. 1-3, one embodiment of a device 10 for increasing the range of motion of a knee joint 12 of a patient 14 is shown. The device 10 generally comprises a frame 16 for supporting the patient 14, a lever member 18 pivotally coupled to the frame 16, and an actuator 20 for driving the lever member 18 through an arcuate path. One or more legs 22 of the patient 14 may be directed by the lever member 18 along at least a portion of the arcuate path as well. As will be described in greater detail below, this aspect enables the device 10 to be used to increase extension and/or flexion of the knee joint 12.

FIGS. 2 and 3 illustrate the components of one embodiment of the device 10 in further detail. In the illustrative embodiment shown, the frame 16 includes a main body 26 and a base member 28 coupled to the main body 26. The main body 26 has a triangular-like profile with a first corner portion 30 supported on a ground surface 32. A second corner portion 34 and a third corner portion 36 are substantially the same distance above the ground surface 32 so that the main body 26 includes a substantially horizontal top surface 38. To stabilize the main body 26, a support leg 40 extends from the main body 26 to the base member 28, which is supported on the ground surface 32 below the third corner portion 36. The base member 28 may include, for example, a transverse beam member 42 and first and second arm members 44, 46 extending from the transverse beam member 42. Such an arrangement effectively prevents the device 10 from falling or tipping over, although those skilled in the art will appreciate that a wide variety of other arrangements are possible to achieve this same effect.

The main body 26 and base member 28 of the frame 16 may be integrally formed together as components of a unitary structure or may be separate components secured together. For example, with respect to the former possibility, the main body 26 and base member 28 may each be formed from metal and welded together to define a unitary structure. With respect to the latter possibility, the base member 28 may be removably secured to the main body 26 using conventional techniques, such as fastening or press-fitting. In some embodiments, the main body 26 and/or base member 28 may each be formed from a number of different components that may be easily disassembled to facilitate storage and transportation of the device 10 during non-use.

The main body 26 of the frame 16 is configured to support the patient 14 in a manner that allows motion of the knee joint 12. For example, the main body 26 may support a seat 50 on the substantially horizontal top surface 38 above the third corner portion 36. The seat 50 may be provided with padding or the like to increase comfort. When the patient 14 sits on the seat 50, his or her knee joint 12 may extend over an outer edge 52 of the seat 50. Because of the shape of the main body 26, the legs 22 of the patient 14 are free to bend downwardly (at the knee joint 12) toward the ground surface 32. The seat 50 is supported above the ground surface 32 a sufficient distance to prevent the legs 22 from contacting the ground surface 32.

The device 10 may further include a back support 58 to help properly position the patient 14 on the seat 50 and to provide additional comfort. In one embodiment, the back support 58 comprises a cushioned member 60 coupled to a support frame 62. The cushioned member 60 may be constructed of any material designed to at least partially conform to the shape of the patient's back. Additionally, both the angular orientation and lateral position of the cushioned member 60 relative to the seat 50 may be adjusted as needed to better accommodate and support the patient 14.

For example, the support frame 62 of the back support 58 may include a first rail member 64 and a second rail member 66 (FIG. 1) having substantially the same profile. The first rail member 64 and second rail member 66 are spaced apart from each other and configured to receive the main body 26 of the frame 16 therebetween. To position the back support 58 relative to the frame 16, a bolt or similar structure (not shown for clarity) may be inserted through a first hole 68 in each of the first and second rail members 64, 66. Another bolt or similar structure (also not shown for clarity) may be inserted through a second hole 70 in an arcuate segment 76 of each of the first and second rail members 64, 66. Elongated slots 72 extending through the main body 26 of the frame 16 and aligned with the first and second holes 68, 70 accommodate the bolts. The elongated slots 72 include offset holes 74 to secure the back support 58 in different lateral positions.

Thus, to secure the back support 58 in a particular lateral position relative to the frame 16, the support frame 62 first is adjusted by moving the bolts (which extend through the first holes 68 and second holes 70) along the elongated slots 72. When aligned with a set of the offset holes 74, the bolts are moved into that set of the offset holes 74. As a result, the bolts are no longer positioned in the elongated slots 72 such that lateral movement relative to the frame 16 is reduced or eliminated. Attempting such movement merely results in the bolts contacting edges of the associated offset holes 74.

The angular orientation of the cushioned member 60 may be adjusted by first removing the bolt from the second hole 70 in each of the first and second rail members 64, 66. Tilting the cushioned member 60 in a particular direction then brings one of several alternative holes 80 into alignment with the corresponding elongate slot 72. Once one of the alternative holes 80 on each of the first and second rail members 64, 66 is aligned with the elongate slot 72, the bolt may then be inserted through that set of holes 80 and the elongated slot 72 so that the angular orientation of the cushioned member 60 can no longer be adjusted. Although FIGS. 1-3 illustrate the alternative holes 80 being spaced along a length of the arcuate segment 76 of each of the first and second rail members 64, 66, additional holes (not shown) may also or alternatively be provided proximate the first hole 68 in each of the first and second rail members 64, 66.

When the patient 14 is supported on the frame 16, a thigh support 84 extending upwardly from the third corner portion 36 of the main body 26 may be positioned between the legs 22 of the patient 14. The thigh support 84 may include a first beam member 86 extending substantially vertically from the main body 26, a second beam member 88 telescopically received in the first beam member 86, and a transverse support bar 90 coupled to the second beam member 88 and configured to extend over the legs 22. The seat 50 may include a gap 93 between a first front portion 92 and a second front portion 94 to accommodate the first beam member 86. Additionally, padding 96 may be provided on the transverse support bar 90 on opposite sides of the second beam member 88. In one embodiment, the padding 96 comprises cylindrical pads or rollers constructed from foam or another material designed to provide cushioning. The space between the padding 96 and seat 50 may be adjusted by sliding the second beam member 88 relative to the first beam member 86. To lock the second beam member 88 in position, a locking pin (not shown) may be inserted through holes (not shown) in the first and second beam members 86, 88 that become aligned. Other techniques for maintaining a desired space between the padding 96 and seat 50 may be used instead of, or in addition to, this type of locking pin arrangement.

The lever member 18 is configured to bear against the legs 22 or another nearby portion of the patient's body below the knee joint 12, such as feet 98 of the patient 14, when the patient 14 is supported on the frame 16. Similar to the thigh support 84, the lever member 18 may include a first beam member 102, a second beam member 104 telescopically received in the first beam member 102, and a transverse leg support 106 coupled to the second beam member 104. The telescoping arrangement between the first beam member 102 and second beam member 104 enables the length of the lever member 18 to be adjusted so that the transverse leg support 106 can be properly positioned relative to the legs 22 of the patient 14. For example, the first beam member 102 and second beam member 104 may include holes (not shown) that become aligned when the lever member 18 is adjusted to certain lengths. A locking pin (not shown) may be inserted through the holes to maintain the lever member 18 at these lengths. However, it will be appreciated that the lever member 18 may be adjusted to and maintained at different lengths using any other suitable technique.

In one embodiment, the first beam member 102 of the lever member 18 is pivotally coupled to a support bar 110 projecting from the first beam member 86 of the thigh support 84. As a result, the lever member 18 can pivot about a pivot point 112 to help move the legs 22 of the patient 14 along an arcuate path. Because the pivot point 112 may not be directly aligned with the knee joint 12, the path followed by the legs 22 may be slightly different than the path of the transverse leg support 106. The position of the transverse leg support 106 along the legs 22 may therefore change through the range of motion. To account for this change, padded rollers 114 may be provided on the transverse leg support 106. The padded rollers 114, like the padding 96, may be constructed from foam or any other material that provides a degree of cushioning. Because the padded rollers 114 are configured to freely rotate on the transverse leg support 106, the lever member 18 may move along the legs 22 of the patient 14 as necessary while it moves along its arcuate path.

Still referring to FIGS. 2 and 3, the actuator 20 is pivotally coupled to both the frame 16 and the lever member 18 and configured to generate a translational input that rotates the lever member 18 relative to the frame 16. For example, the actuator 20 may include a drive member 120, a tube 118 that operatively couples the drive member 120 to the main body 26 at a pivot point 116, and a shaft 122 slidably received in at least a portion of the tube 118. The shaft 112 includes an end portion 124 pivotally coupled to the lever member 18 at a pivot point 126 on the first beam member 102. The drive member 120 is configured to displace the shaft 122 in a substantially linear direction away from the drive member 120. However, because the tube 118 is pivotally coupled to the frame 16 and the shaft 122 is pivotally coupled to the lever member 18, this linear displacement causes the lever member 18 to rotate about the pivot point 112.

In one embodiment, the drive member 120 is an electric motor connected to a power source, such as an AC power outlet or batteries. The tube 118 is mounted to the drive member 120 and houses components that translate rotary motion from the drive member 120 into linear motion. The shaft 122 is displaced by these components and slides relative to the tube 118. Thus, in such an embodiment, the actuator 20 comprises an electromechanical linear actuator, although the invention is not so limited. The actuator 20 may alternatively be a hydraulic actuator or any other suitable device capable of generating an input that rotates the lever member 18 relative to the frame 16. A controller (not shown) held by the patient 14 or mounted to the frame 16 may be used to operate the actuator 20 in a desired manner.

In use, the patient 14 first adjusts the back support 58 to a desired position using the techniques discussed above. Prior to or after sitting on the seat 50, the patient 14 uses the controller to operate the actuator 20 and adjust the angular orientation of the lever member 18 relative to the frame 16. The lever member 18 may be moved to a position along its arcuate path of motion to which the patient 14 can easily move his or her legs 22. For example, stiffness in the knee joint 12 may limit the number of positions along the arcuate path to which the patient 14 can position his or her legs 22 without assistance. When the device 10 is used to help increase extension of the knee joint 12, the patient 14 may first use the controller to rotate the lever member 18 toward the frame 16. Once the lever member 18 is set in a desired initial position, the patient 14 places his or her legs 22 in front of the padded rollers 114 on the transverse leg support 106.

Next, with the legs 22 properly positioned, the patient 14 may adjust the thigh support 84 to bring the padding 96 into contact with his or her thighs 140 near the knee joint 12. The three points or areas of contact with each leg 22 created by the seat 50, padding 96, and padded rollers 114 helps stabilize each leg 22 and isolates the knee joint 12 for rotation. Using the controller, the patient 14 then operates the actuator 20 to extend the shaft 122 outwardly from the drive member 120 and thereby rotate the lever member 18 about the pivot point 112. As the lever member 18 rotates away from the frame 16, the transverse leg support 106 bears against a rear portion 142 of each leg 22 and causes the legs 22 to move along an arcuate path. The knee joint 12 is stretched in extension as the legs 22 move along the arcuate path. FIG. 2 illustrates the legs 22 in a fully extended position, although the knee joint 12 need not be stretched to such an extent during use. Instead, the device 10 may be used to stretch the knee joint 12 through a particular range of motion.

Advantageously, the patient 14 controls the degree to which the knee joint 12 is stretched when using the device 10. In particular, the controller allows the patient 14 to operate the device 10 so that his or her knee joint 12 is stretched slightly beyond the range of motion through which the patient 14 can bend his or her legs 22 without assistance. If the patient 14 begins to experience significant pain or discomfort as his or her legs 22 are extended, he or she simply uses the controller to stop further rotation of the lever member 18. After holding the stretch for a desired period of time, the patient 14 can operate the actuator 20 in a reverse direction. The drive member 120 retracts the shaft 122 when operated in the reverse direction and causes the lever member 18 to rotate back toward the frame 16. The stretching cycle may then be repeated a certain number of times or for a certain period of time. To this end, the device 10 may be controlled to simulate the variable load, short duration stretching a patient typically receives from a physical therapist to treat joint stiffness. The controller may be operated manually to simulate this treatment or may be programmed to automatically operate the actuator 20 in a manner that simulates this treatment.

A similar protocol may be followed to help the patient 14 increase flexion of the knee joint 12. In such a situation, the patient 14 places his or her legs behind the padded rollers 114 on the transverse leg support 106 after moving the lever member 18 into a desired initial position. The shaft 122 of the actuator 20 will typically be extended from the tube 118 and drive member 120 in the initial position. Using the controller, the patient 14 then operates the actuator 20 to retract the shaft 122 toward the drive member 120. This retraction causes the lever member 18 to rotate about the pivot point 112 toward frame 16. As shown in FIG. 3, the transverse leg support 106 bears against a front portion 144 of each leg 22 and causes the legs 22 to move along an arcuate path. The legs 22 bend at the knee joint 12 as they move along the arcuate path to stretch the knee joint 12 in flexion.

Thus, the device 10 may be used to achieve both an extension and flexion stretch of the knee joint 12. This represents a significant advantage over conventional in-home mechanical therapy devices, which are typically designed to achieve only one type of stretch. Moreover, the device 10 is easy to operate when compared to other in-home mechanical therapy devices. The patient 14 merely needs to operate the controller by pressing switches, buttons, or the like to effect treatment rather than having to manually actuate levers or other components. Additionally, the frame 16 comfortably supports the patient 14 while treatment is effected, allowing the patient 14 to perform other activities at the same time. For example, as shown in FIG. 1, the patient 14 may talk on a phone while using the device 10. The patient 14 may also watch television or enjoy similar activities while treatment is effected.

During non-use, the device 10 may easily be moved to a corner of a room, a closet, or some other area in a patient's home convenient for storage. For example, a least one wheel or roller 150 may be provided on the frame 16 to facilitate transporting the device 10 across the ground surface 32. The embodiment shown in FIGS. 1-3 includes rollers 150*a*, 150*b* provided on the respective first and second arms 44, 46 of the base member 28. The device 10 may also include a handle 154 extending from the main body 26. When the handle 154 is lifted, the first corner portion 30 is raised off the ground surface 32 so that the device 10 is primarily supported by the rollers 150*a*, 150*b*. As a result, the device 10 may then be easily moved across the ground surface 32. Additional handles (not shown) may be provided elsewhere on the frame 16 to further facilitate transport.

By following a prescribed protocol of stretching using the device 10, the range of motion of the knee joint 12 may be increased. Indeed, the device 10 may be used to reduce or, in some instances, eliminate the need for physical therapy. This typically saves the patient 14 time and money. In other instances, the device 10 may be used to increase the range of motion of a knee joint when traditional therapy and stretching techniques have failed to effectively treat joint stiffness. The device 10 thus provides the patient 14 with another treatment option before surgical intervention is required to break up scar tissue.

While the invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. For example, the lever member 18 may further include an additional transverse leg support and set of padded rollers (not shown) above or below the transverse leg support 106 and padded rollers 114. A patient could then position his or her legs between the two sets of padded rollers during use. This would allow the patient to use the device 10 to follow both flexion and extension protocols without having to reposition his or her legs with respect to the rollers 114. Additionally, those skilled in the art will appreciate that the frame 16, seat 50, lever member 18, or any other component may be reconfigured as necessary so that the device 10 may be used to increase the range of motion of other body parts, such as ankles and shoulders.

Therefore, the invention in its broader aspects is therefore not limited to the specific details, representative apparatus and methods and illustrative examples shown and described. Accordingly, departures may be made from such details without departing from the scope or spirit of the general inventive concept.

What is claimed is:

1. A device for increasing the range of motion of a patient's knee joint, comprising:

a frame including a front end and a back end;

a seat coupled to the frame and configured to support the patient in a manner that allows motion of the patient's knee joint;

a thigh support assembly projecting upwardly from the frame and configured to support an upper surface of the patient's thigh when seated on the seat;

a lever member pivotally coupled to the thigh support assembly at a pivot point;

a transverse leg support coupled to the lever member and configured to bear against a portion of the patient's body below the patient's knee joint when the patient is supported on the seat;

an actuator including no more than two pivotal connections and generating a translational input movement between the two pivotal connections generally along a vertical plane defined by a centerline of the seat, the first pivotal connection being with the frame at a location between the front and back ends and the second pivotal connection being with the lever member at a location between the pivot point and the transverse leg support; and a controller configured to operate the actuator, wherein the translational input movement generated by the actuator rotates the lever member relative to the frame and thereby stretches the patient's knee joint in a desired direction.

2. The device of claim 1, wherein the actuator comprises an electromechanical linear actuator.

3. The device of claim 1, wherein the lever member has an adjustable length.

4. The device of claim 3, wherein the lever member further comprises a first beam member pivotally coupled to the frame at the pivot point and a second beam member telescopically received in the first beam member, the transverse leg support being coupled to the second beam member.

5. The device of claim 1, wherein the lever member further comprises at least one roller received on the transverse leg support, the at least one roller being configured to freely rotate on the transverse leg support.

6. The device of claim 1, wherein the seat for supporting the patient is at the front end of the frame, the actuator being configured to rotate the lever member to bring the transverse leg support under the seat between the front and back ends of the frame thereby stretching the patient's knee joint in flexion.

7. The device of claim 6, wherein the thigh support assembly further comprises:

a transverse support bar spaced above the seat, the thigh support assembly being adjustable to change the spacing between the seat and the transverse support bar.

8. A device for increasing the range of motion of a patient's knee joint, comprising:

a frame including a front end, a back end;

a seat supported on the front end, the seat being configured to support the patient in a manner that allows motion of the patient's knee joint;

a thigh support assembly projecting upwardly from the frame and configured to support an upper surface of the patient's thigh when seated on the seat;

a lever member pivotally coupled to the thigh support assembly at a pivot point, the lever member including a roller configured to bear against a portion of the patient's body below the patient's knee joint when the patient is supported on the seat, the lever member being rotatable between a retracted position wherein the roller is located under the seat to stretch the patient's knee joint in flexion and an extended position wherein the roller is located in front of the seat to stretch the patient's knee joint in extension;

an actuator including no more than two pivotal connections, a drive member defining the first pivotal connection with the frame at a location between the front and back ends, and a shaft extending from the drive member generally along a vertical plane defined by a centerline of the seat, the shaft having an end portion defining the second pivotal connection with the lever member at a location between the pivot point and the roller; and a controller configured to operate the actuator, wherein the drive member is configured to selectively move the shaft in a substantially linear direction to generate a translational input movement between the two pivotal connections that rotates the lever member relative to the frame between the retracted and extended positions.

9. The device of claim 8 wherein the drive member is an electric motor.

10. A method of increasing the range of motion of a patient's knee joint using a device having a frame with a seat positioned between a front end and a back end, a thigh support assembly projecting upwardly from the frame and a lever member pivotally coupled to the thigh support assembly at a pivot point and including a transverse leg support, and an actuator including no more than two pivotal connections, the first pivotal connection being with the frame at a location between the front and back ends and the second pivotal connection being with the lever member at a location between the pivot point and the transverse leg support, the method comprising:

positioning a patient on the seat so that the patient is supported in a manner that allows motion the patient's knee joint;

positioning the thigh support assembly against an upper surface of the patient's thigh;

positioning the transverse leg support of the lever member against a portion of the patient's body below the patient's knee joint; and operating the actuator with a controller to generate a translational input movement generally along a vertical plane defined by a centerline of the seat that rotates the lever member relative to the frame and thereby stretches the patient's knee joint.

11. The method of claim 10, wherein the actuator includes a drive member pivotally coupled to the frame and a shaft having an end portion pivotally coupled to the lever member, and wherein operating the actuator further comprises:

operating the drive member to move the shaft in a substantially linear direction and thereby generate the translational input movement.

12. The method of claim 11, wherein the transverse leg support of the lever member is positioned against a front portion of the patient's leg below the knee, and wherein operating the drive member further comprises:

retracting the shaft toward the drive member to rotate the lever member to a retracted position wherein the transverse leg support is located under the seat thereby stretching the patient's knee joint in flexion.

13. The method of claim 12, further comprising:

re-positioning the transverse leg support of the lever member against a rear portion of the patient's leg below the knee; and extending the shaft away the drive member to rotate the lever member to an extended position wherein the transverse leg support is in front of the seat thereby stretching the patient's knee joint in extension.

14. The device of claim 1 wherein the frame includes a main body having a triangular-like profile, the main body having a first corner portion configured to be supported on a ground surface, second and third corner portions configured to be supported substantially the same distance above the ground surface, and a substantially horizontal top surface extending between the second and third corner portions.

15. The device of claim 14 wherein the frame further includes a base member coupled to the main body and configured to be supported on the ground surface below the third corner portion.

16. The device of claim 1 further comprising:

at least three points of contact with the patient when seated thereon including the seat, the thigh support assembly and the transverse leg support to thereby stabilize the leg of the patient and isolate the knee joint for rotation during use of the device.

17. The device of claim 1 wherein the pivot point between the thigh support assembly and the lever member is located proximate a plane of the seat.

18. The device of claim 9 further comprising:

at least three points of contact with the patient when seated thereon including the seat, the thigh support assembly and the transverse leg support to thereby stabilize the leg of the patient and isolate the knee joint for rotation during use of the device.

19. The device of claim 18 wherein the pivot point between the thigh support assembly and the lever member is located proximate a plane of the seat.

20. The method of claim 10 further comprising:

positioning the pivot point between the lever member and the thigh support assembly proximate a plane of the seat and below the patient's knee joint.

* * * * *